United States Patent [19]

Mekler

[11] 4,206,603

[45] Jun. 10, 1980

[54] SINGLE HAND OPERATED TOOL

[76] Inventor: Dan Mekler, 18 Methodela St., Jerusalem, Israel

[21] Appl. No.: 959,230

[22] Filed: Nov. 9, 1978

Related U.S. Application Data

[63] Continuation-in-part of Ser. No. 815,377, Jul. 13, 1977, Pat. No. 4,149,381.

[51] Int. Cl.[2] ..... F15B 15/18

[52] U.S. Cl. ..... 60/477; 60/481; 60/DIG. 10; 60/468; 30/180

[58] Field of Search ..... 60/413, 477, 478, 479, 60/481, DIG. 10, 468, 494; 30/180; 81/301

[56] References Cited

U.S. PATENT DOCUMENTS

| | | | |
|---|---|---|---|
| 2,250,551 | 7/1941 | Pfauser | 417/287 |
| 2,820,415 | 1/1958 | Born | 417/287 |
| 2,979,032 | 9/1961 | Engquist et al. | 60/481 X |
| 3,058,214 | 10/1962 | Mekler | 60/477 X |
| 4,149,381 | 4/1979 | Mekler | 60/477 |

*Primary Examiner*—Edgar W. Geoghegan
*Attorney, Agent, or Firm*—Sandler & Greenblum

[57] ABSTRACT

A single hand held and operated tool comprising a housing; a hydraulic fluid reservoir located in the housing; a hydraulic pressure cylinder located in the housing; a hydraulic piston moving with respect to the pressure cylinder in response to hydraulic pressure produced therein; a hydraulic pump operable by a single hand while grasping the housing and coupled to the fluid reservoir and to the pressure cylinder for forcing hydraulic fluid received from the reservoir into the cylinder; and valve apparatus governing fluid communication between the hydraulic pump and the pressure cylinder and operative in response to hydraulic pressure in the cylinder for lowering the quantity of hydraulic fluid supplied to the cylinder by each pump stroke when the pressure in the cylinder exceeds a predetermined pressure, thus providing two-speed tool operation.

9 Claims, 16 Drawing Figures

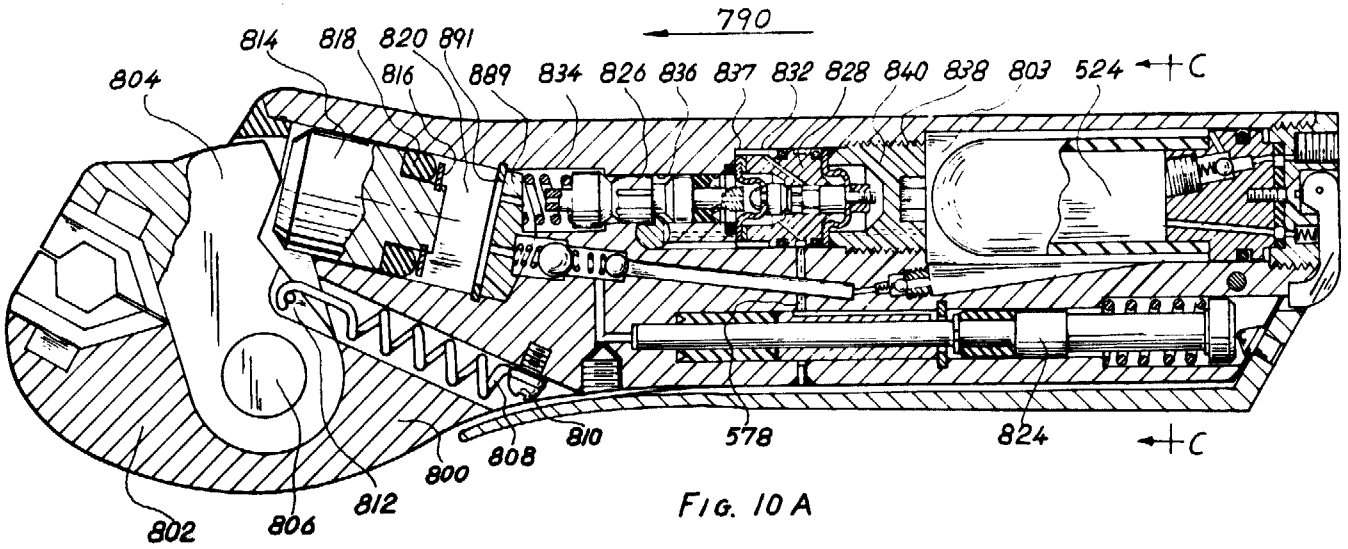
FIG. 10 A
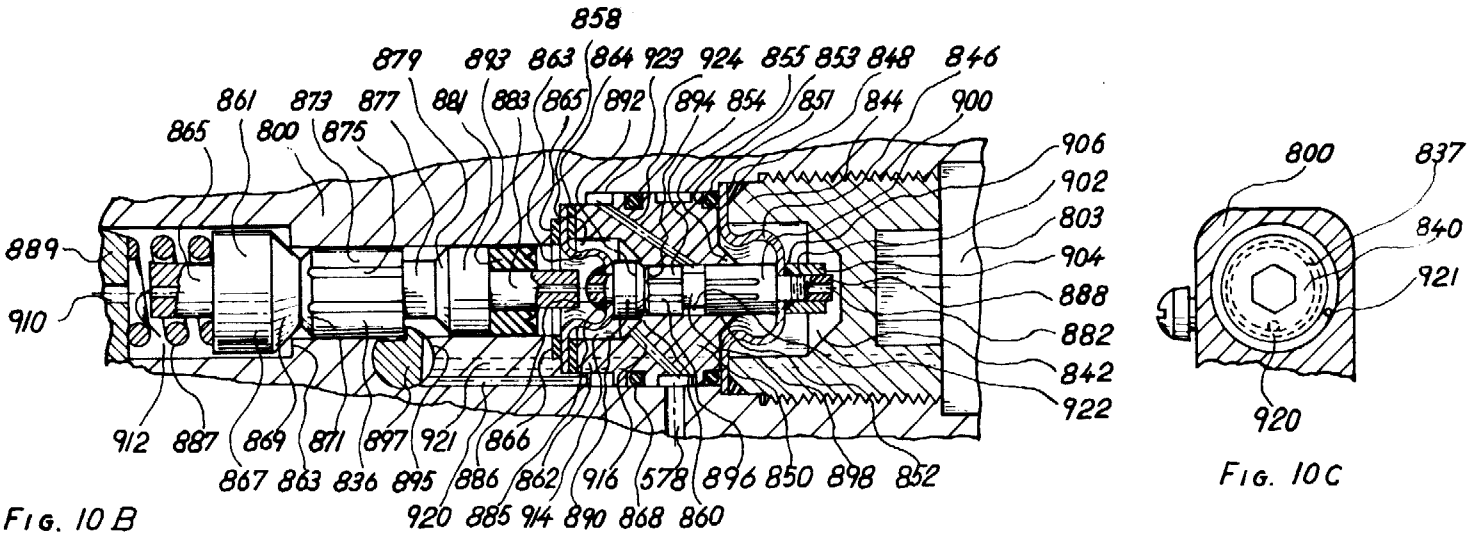
FIG. 10 B
FIG. 10 C

SINGLE HAND OPERATED TOOL

This is a continuation-in-part of U.S. Pat. Application Ser. No. 815,377, filed July 13, 1977, now U.S. Pat. No. 4,149,381, issued Apr. 17, 1979.

FIELD OF THE INVENTION

The present invention relates to hydraulic tools which may be held, operated and released with a single hand, unassisted, and more particularly to tools such as crimpers, swagers and cutters.

BACKGROUND OF THE INVENTION

Various types of hydraulic tools such as wrenches or pliers which may be held in one hand are known. The vast majority of these, however, require both hands of an operator to effect tool engagement or disengagement with the workpiece.

U.S. Pat. No. 3,058,214 of the present inventor shows a one-hand hydraulic tool comprising a frame and a stationary jaw fixed thereto; a movable jaw pivotally mounted in the frame for movement towards and away from the stationary jaw and including a cam member; a hydraulic power system disposed in the frame and including a liquid tank, a piston reciprocable in a cylinder and adapted to be pressed unconnectedly against the cam member of the movable jaw, thereby to impart a moment to the movable jaw, a pump connected to the tank by a suction duct and to the cylinder by a delivery duct, check valves in the suction and delivery ducts, a return duct from the cylinder to the tank, and a pressure release valve in the frame member for the operation of the tool; springy means acting on the movable jaw in opposition to the moment imparted to the movable jaw by the pressure exerted on the cam member by the hydraulic piston; and non-hydraulic means for mechanically imparting to the movable jaw a moment co-directional with the moment imparted to the movable jaw by the piston.

There is described and illustrated hereinbelow and claimed in copending U.S. Pat. App. Ser. No. 815,377 a further improvement and refinement of the apparatus described in the aforesaid U.S. patent and provides apparatus having enhanced ease of disengagement. There is thus provided in accordance with an embodiment of the invention a single-hand operated tool comprising:

first and second relatively movable elements adapted to be associated with a head assembly for application of pressure to a workpiece;

a housing;

a hydraulic pump disposed within said housing;

hydraulic fluid communication means associated with said pump for exerting hydraulic force on said relatively movable elements;

articulated lever means associated with said pump and arranged such that reciprocal motion of said lever means provided by the action of a single hand, unassisted, operates said pump and produces a desired force on said workpiece;

release valve means for releasing the force exerted by said hydraulic fluid in response to a manual actuation produced by said single hand and including a valve stem and seat wherein the force urging seating of the valve stem against the valve seat is smaller than said desired force.

Additionally in accordance with an embodiment of the invention there is provided interchangeable hand held tool apparatus as described above wherein the first and second relatively movable members are coaxially disposed for engagement with an interchangeable head assembly and operation thereof.

The tools described above operate at a single speed and while they are provided with overpressure and overextension limiting means, they do not include automatic release apparatus operative at a selectable pressure threshold as would be particularly useful in crimping for producing uniform crimps.

Hydraulic jacks and pumps which operate at two speeds are well known. Examples are illustrated in U.S. Pats. Nos. 2,250,551 and 2,820,415. Shifting from one speed to another is accomplished in response to exceedance of a pressure threshold. This pressure threshold is established by a spring-loaded pressure sensitive valve which is operative to short circuit one of two pumping conduits when high pressures are encountered. It is to be emphasized that the known hydraulic jacks and pumps are relatively large tools operating at high fluid volume and relatively low pressure and are not designed to be small or to be operable by one hand of an operator.

In order to scale down the weight and physical size of hydraulic tools for the purpose of rendering them hand held and operable by one hand unassisted, the operating pressure thereof must be increased significantly. Otherwise the resultant force produced thereby would be scaled down proportionately with the tool size, greatly decreasing the tool's usefulness.

Conventional hydraulic tools operate at pressures up to about 10,000 p.s.i., that is, about 700 Atmospheres. Increasing the operating pressure above these limits involves difficulties arising out of the greatly increased forces exerted on the operating components of the tool, such as valves, valve stems and springs. Also, at such high pressures, the compressability of hydraulic fluid becomes a significant factor. These difficulties can be appreciated from a consideration of hydraulic devices known from the prior art. If one calculates the forces that result from multiplication of an operating pressure exceeding 700 Atm. by the exposed surface area of the parts concerned, one will find forces in the order of hundreds of kilograms, even if one designs the parts to be as small as possible.

Therefore, large forces require large springs and large valve stems to accommodate them. The large size of the springs and valve stems requires enlargement of the parts associated therewith and as a result the forces are further increased. It may thus be appreciated that a "vicious circle" is involved in the conventional design of high pressure tools in scaled down dimensions.

It is also to be appreciated that conventional hydraulic tools are not designed to be held and operated by one hand. Such tools therefore do not involve difficulties connected with the displacement of small amounts of hydraulic fluid. In the compression of very small amounts of hydraulic fluid, the compressability of the fluid becomes significant because when high pressures are reached the fluid is readily compressed to an extent that insufficient fluid remains to perform the required work.

It may thus be understood that scaling down of conventional hydraulic tools involves not only the problem of too-large forces but also the problem of fluid compressibility. No solutions to these problems have been proposed in the prior art.

SUMMARY OF THE INVENTION

The present invention seeks to improve upon hand-held and operated tools which are the subjects of U.S. Pat. No. 3,058,214 and co-pending U.S. Pat. Application Ser. No. 815,377, both of the present inventor, and to provide a single hand held and operated tool having automatic two speed operation and additionally or alternatively automatic release.

There is thus provided in accordance with an embodiment of the present invention a single hand held and operated tool comprising a housing; a hydraulic fluid reservoir located in the housing; a hydraulic pressure cylinder located in the housing; a hydraulic piston moving with respect to the pressure cylinder in response to hydraulic pressure produced therein; a hydraulic pump operable by a single hand while grasping the housing and coupled to the fluid reservoir and to the pressure cylinder for forcing hydraulic fluid received from the reservoir into the cylinder; and valve apparatus governing fluid communication between the hydraulic pump and the pressure cylinder and operative in response to hydraulic pressure in the cylinder for lowering the quantity of hydraulic fluid supplied to the cylinder by each pump stroke when the pressure in the cylinder exceeds a predetermined pressure, thus providing two-speed tool operation.

Also in accordance with an embodiment of the invention there is provided automatic release apparatus associated with the valve apparatus and with the release valve for automatically operating the release valve when the pressure in the cylinder as sensed by the valve apparatus exceeds a second predetermined pressure.

Further in accordance with an embodiment of the invention, the valve apparatus comprises a differential valve. Additionally in accordance with an embodiment of the invention, the valve apparatus comprises at least one spring diaphragm.

Additionally in accordance with an embodiment of the invention there is provided hydraulic apparatus comprising a housing, a hydraulic fluid reservoir; a hydraulic pump coupled to the fluid reservoir and to an associated pressure cylinder for forcing hydraulic fluid received from the fluid reservoir into the pressure cylinder and valve apparatus governing fluid communication between the hydraulic pump and the pressure cylinder and operative in response to hydraulic pressure in the cylinder for lowering the quantity of hydraulic fluid supplied to the cylinder by each pump stroke when the pressure in the cylinder exceeds a predetermined pressure, thus providing two-speed operation, the valve apparatus comprising at least one diaphragm spring.

BRIEF DESCRIPTION OF THE DRAWINGS

The invention will be more fully understood and appreciated from the following detailed description taken in conjunction with the drawings in which:

FIG. 10A is a schematic side view sectional illustration of a single hand operated cutting and crimping tool constructed and operative in accordance with an embodiment of the present invention;

FIG. 10B is a detailed sectional illustration of the release valve and two-speed valve apparatus shown in FIG. 10A;

FIG. 10C is a sectional illustration taken along the lines C—C in FIG. 10A;

DETAILED DESCRIPTION OF THE INVENTION

Figure 2:
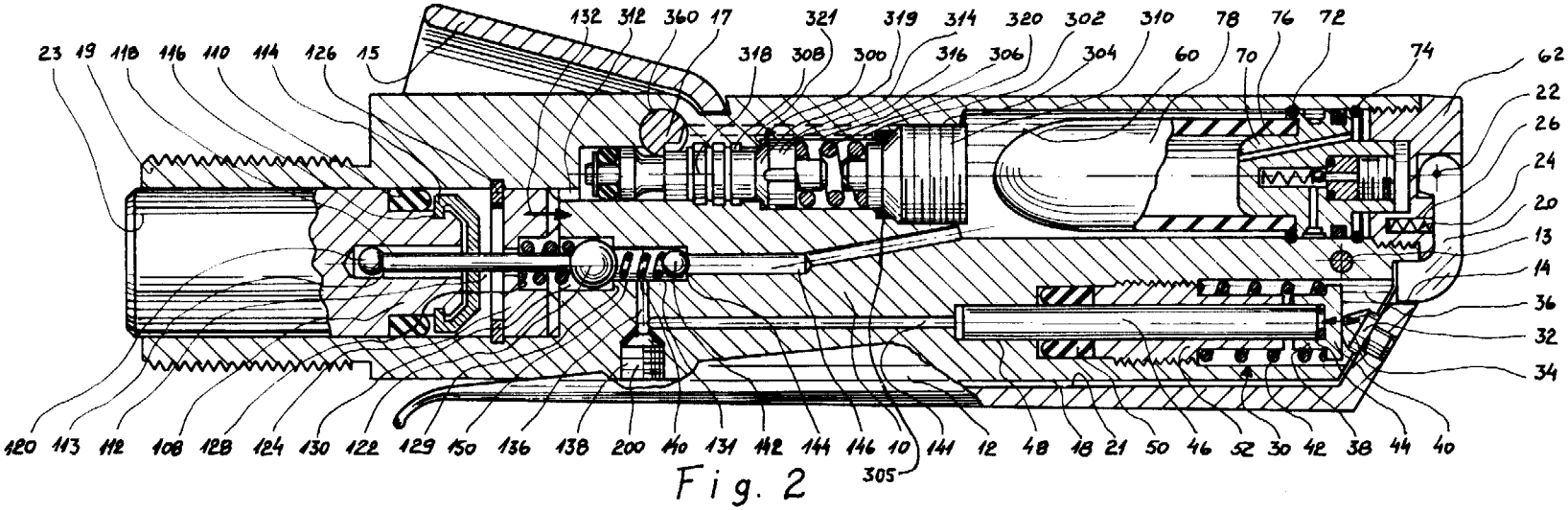
FIG. 2 is a sectional side view illustration of the hand tool of FIG. 1.
Figure 1:
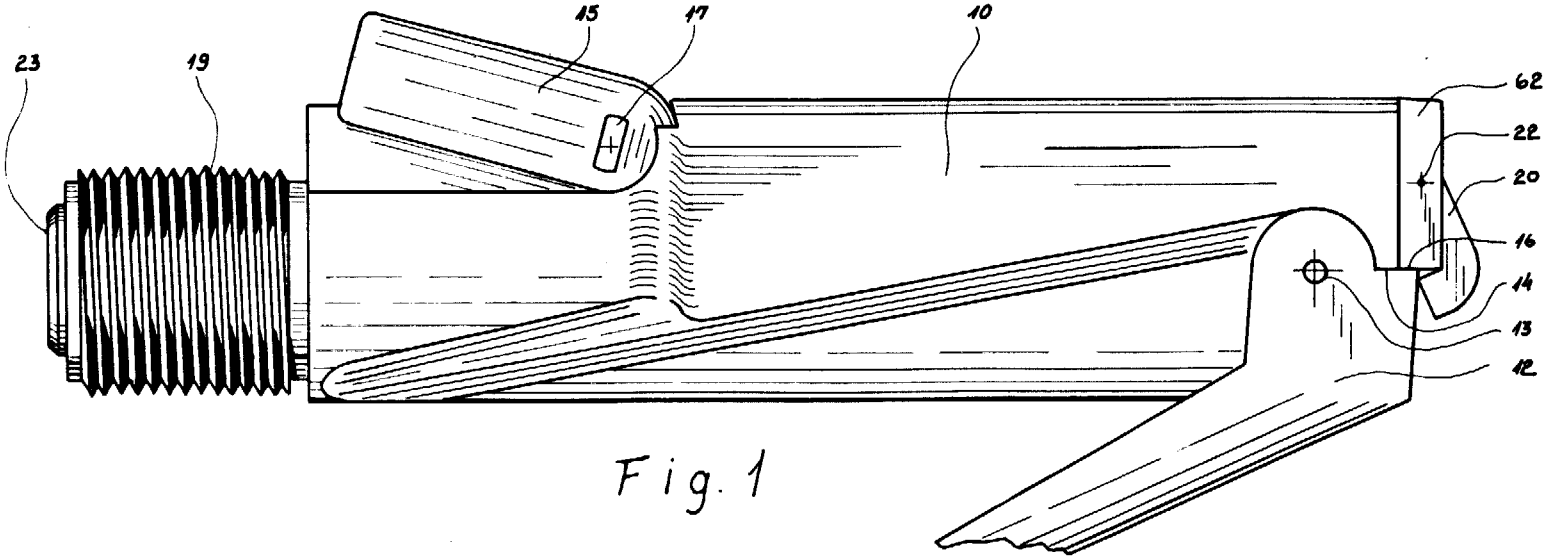
FIG. 1 is a pictorial side view of illustration of a hand held tool constructed and operative in accordance with an embodiment of the invention.

Referring now to FIGS. 1 and 2, there is seen a single-hand held tool comprising a housing 10 generally formed of a unitary block of metal such as steel, hardened so as to be able to withstand the forces generated during tool operation. A lever 12 is pivotably attached onto housing 10 at a pivot axis 13 fixed in the housing and located so as to permit relative reciprocal motion between lever 12 and housing 10 about axis 13. Lever 12 and housing 10 are configured to provide respective confronting surfaces 14 and 16 which define the limit of outward travel of lever 12 with respect to housing 10. The limit of inward travel of lever 12 is defined by confronting surfaces 18 and 21 respectively of housing 10 and lever 12.

It is appreciated that the exemplary embodiment of FIGS. 1 and 2 is illustrated at approximately one and one half times actual size; thus the length of lever 12 and the maximum outward disposition thereof are accommodated to single hand operation of the device.

Lever 12 drivingly engages a hydraulic pump assembly indicated generally by reference numeral 30 via a contact knob 32 which moves during reciprocal motion of lever 12 along a path indicated generally by arrows 34.

Pump assembly 30 is disposed within a suitably configured recess 36 formed, as by boring, in housing 10 and comprises a pump head 38 adapted to be engaged by contact knob 32 formed with a flange 40 to serve as a seat for a return spring 42. Head 38 is also configured to have a central recess 44 arranged to accommodate a pump shaft 46 which is fixedly mounted with respect thereto. Pump shaft 46 is driven for reciprocal motion in a complementarily configured recess 48 and through a center recess defined in a hydraulic fluid seal 50 which is in turn maintained in a desired location by a centrally bored bushing 52. Bushing 52 is threadably engaged with a similarly threaded portion of recess 36 and also serves as a fixed support bulkhead for spring 42.

Lever 12 may be maintained in a closed position with respect to the housing by means of a rotatable locking member 20 which is pivotably mounted on an axis 22 defined within a cap member 62 (to be described hereinafter) for selectable engagement with surface 14.

A spring 24 located in a recess 26 formed in cap member 62 urges member 20 outwardly and out of engagement with surface 14. Such outward travel, however, is permitted only when lever 12 is manually pushed fully into its inward lying position thus bringing surface 14 out of engagement with member 20.

Locking catch member 20 is thus insertable between surfaces 14 and 16 upon lever 12 being disposed fully inwardly against housing 10. The subsequent release of lever 12 when catch member is located between surfaces 14 and 16 is operative to lock the catch member in place as the result of the force of return spring 42 of pump assembly 30 which acts on the lever via pump head 38 and contact knob 32.

A lever 15 is rotatably mounted onto housing 10 for rotation about pivot axis 17. Lever 15 is operative for pressure release as will be described hereinafter.

The relative location of levers 12 and 15 is selected to enable complete operation of the tool with one hand of which four fingers engage lever 12 for pumping and the thumb engages lever 15 for pressure release.

First and second relatively movably concentric elements, typically a cylindrical housing 19 and a piston 23 as illustrated are located at an extreme end of housing 10 and serve as the working members of the tool to which various operating heads may be attached for various specific purposes. It is appreciated that various types of alternative relatively movable working elements may be provided, for example, non-concentric or non-threaded relatively movable elements may alternatively be employed.

Figure 3:
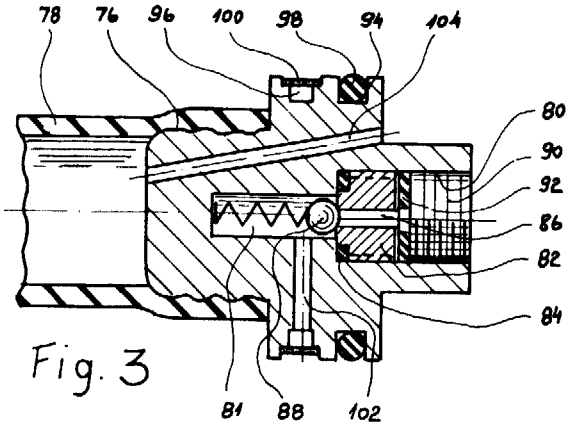
FIG. 3 is a detailed sectional illustration of hydraulic fluid filling apparatus employed in the embodiment of FIGS. 1 and 2.

Reference is now made additionally to FIG. 3 which shows details of a hydraulic fluid filling assembly which may be usefully incorporated in a single hand held hydraulic tool in accordance with an embodiment of the invention.

A fluid filling assembly 70 comprises a neck portion 76 onto which is fitted in hermetic sealing relationship an elastic bladder 78. Assembly 70 is located at a predetermined position in a hydraulic fluid chamber 60 by means of first and second lock rings 72 and 74. Chamber 60 is closed by a cap-member 62 which threadably engages housing 10 without providing a hermetic seal.

Located in a central threaded bore 80 formed in the outer facing end of neck position 76 is a threaded plug 82 formed with a peripheral end seal 84 and having an axial passageway 86 extending therethrough. Exit of fluid from an interior bore 81 being a smaller diameter continuation of bore 80, through passageway 86 is prevented by a spring loaded ball valve assembly 83 mounted inwardly of plug 82 in bore 81 and seating thereon. A second threaded plug 90 maintains an axially apertured seal 92 in engagement with plug 82 and securely seals bore 80.

Neck portion 76 is formed with first and second peripheral grooves 94 and 96. Located in groove 94 is a peripheral ring seal 98 and located in groove 96 is a filter screen 100. Groove 96 communicates with interior bore 81 via a radial bore 102. A duct 104, communicating between the interior of bladder 78 and the outside is also provided for permitting air from the interior of bladder 78 to escape.

The operation of hydraulic fluid filling assembly 70 will now be briefly summarized.

For filling the apparatus with hydraulic fluid, cap member 62 is threadably disengaged from housing 10 and plug 90 is also threadably removed.

For filling the tool with hydraulic fluid a low pressure hydraulic fluid pump is threadably engaged in bore 80. The tool is oriented such that a venting plug 200 (FIG. 2), to be described hereinafter, is oriented facing upward. This venting plug is slightly opened to allow escape of air therethrough during filling. Pumping of the low pressure pump is commenced and continued until fluid appears at plug 200 at which point the plug is tightly closed. Pumping is once again resumed until bladder 78 is fully collapsed as indicated by increased resistance to further pumping. It is noted that the air previously contained within the bladder 78 escapes via duct 104.

It is to be noted that during this filling operation the operating piston 23 is fully contracted.

The low pressure pump is then decoupled from the threaded bore 80 and plug 90 and caps 62 are replaced. It is appreciated that fluid cannot escape through bore 80 due to the operation of spring loaded ball assembly 88. Bladder 78 serves to maintain the hydraulic fluid pressure within storage chamber 60 at a predetermined relatively low pressure, notwithstanding fluid depletion within given limits.

The apparatus driving power piston 23 will now be described.

Power piston 23 moves axially with respect to coaxial threaded cylinder 19. Piston 23 is preferably formed with a lower diameter portion 108 about which is located a high pressure seal 110, typically formed of Neoprene rubber and which lies in sealing engagement between piston 23 and the interior surface of cylinder 19 which defines a pressure chamber 112.

Figure 8:
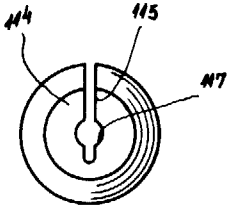
FIG. 8 shows a spring washer member employed in the embodiment of FIGS. 1 and 2.

Seal 110 is retained in position by a spring washer 114 which engages a peripheral groove 116 formed in small diameter portion 108 of piston 23. Spring washer member 114 illustrated in FIG. 8 is suitably configured to have a slit 115 communicating with a central aperture 117, aperture 117 is configured to slidingly accommodate a connecting rod 118.

Disposed within an axial recess 113 formed within piston 23 is one end of connecting rod 118 formed with first and second spherical end members 120 and 122 respectively. The smaller of the spherical members 120, having a diameter greater than that of rod 118 and than that of the corresponding aperture 117 (FIG. 8) on spring washer 114, is inserted within recess 113. Thus spherical member 120 cannot pass through aperture 117 and the outward displacement of piston 23 is thus limited in a manner which will be described hereinafter.

A spring support seat 124 is fixedly mounted in chamber 112 by means of a lock ring 126 fixedly disposed within chamber 112 at a predetermined position. A compression spring 128 is located peripherally of connecting rod 118 within a recess 130 defined in spring support 124 and in the confronting surface of housing 10. Compression spring 128 urges connecting rod 118 in a direction indicated by arrow 132, i.e. against the extension of piston 23.

Spherical member 122 serves two purposes, the first as a spring mounting surface and the second as a valve which seats against a shoulder 129 defined by the opening of a recess 131 formed in housing 10 and communicating with recess 130.

The pressure exerted by spring 128 urges spherical member 122 into sealing engagement in association with shoulder 129 thereby enhancing seating of member 122 irrespective of tool orientation.

Located within recess 131 is a second compression spring 140 associated with a spherical member 142 located adjacent the entrance 144 to conduit 146 communicating with chamber 60. The valve comprising spring 140, spherical element 142 and the valve seat defined at entrance 144 defines a suction valve 150 whose operation will be described hereinafter.

Recess 131 also communicates via a passage 136 with a vent which is sealed by a plug 200. Vents 138 and recess 131 also communicate via a conduit 141 with recess 48 of pump assembly 30 for receipt of pressurized hydraulic fluid therefrom. Conduit 141 is so configured to define a volume sufficiently large such that hydraulic pressure above a predetermined limit cannot be attained due to the compressibility of the hydraulic fluid therein and in the remainder of the hydraulic fluid communication means.

The operation of the hydraulic system for exerting pressure on piston 23 and causing outward travel thereof relative to cylinder 19 will now be briefly summarized.

It is assumed that the hydraulic system is completely filled with fluid by operation of the filling assembly described hereinabove or by any other suitable means. The hydraulic fluid is additionally assumed to be under slight pressure due to the resiliency of bladder 78.

Operation is commenced when the operator grasps housing 10 and lever 12 and presses lever 12 towards housing 10, thereby releasing catch member 20.

Once catch member 20 is released, the force exerted by spring 42 of pump assembly 30 pushes lever 12 outwardly into an angular disposition determined by the orientation of respective bulkheads 14 and 16. Together with lever 12, pump head 38 and shaft 46, fixedly attached thereto, are also drawn to a fully retracted position. Retraction of shaft 46 causes hydraulic fluid to be drawn from fluid storage chamber 60 via conduits 141, 136 and 146 and recess 131. It is appreciated that the suction thus exerted on spherical member 142 against the urging of spring 140 unseats suction valve 150 sufficiently to permit the indicated fluid flow.

The manual application of force on lever 12 urging it towards housing 10 causes forward motion of pump shaft 46 which forces fluid back through conduit 141 to recess 131. Since the fluid is prevented from exiting to conduit 146 by valve assembly 150, it causes the temporary unseating of spherical member 122 from its seat 129 during the pressure portion of the pumping cycle, thereby supplementing hydraulic fluid in recess 112 and forcing piston 23 outwardly with respect to member 19.

Repeated reciprocal motion of lever 12 with respect to housing 10 causes further forward displacement of the piston. Continued operation of the pump and displacement of the piston to a predetermined limit defined by the length of rod 118, causes spring washer 114 to engage spherical member 120 and to pull it, together with rod 118, fixedly attached thereto, in the forward direction. This in turn causes spherical member 122, also fixedly attached to rod 118, to become unseated permanently. In this condition, in contrast to the operation of the device before such a condition is obtained, spherical element 122 does not seat during the suction portion of the pumping cycle and thus fluid pumped thereinto is removed therefrom without inhibition as pump shaft 46 is actuated. As a result piston 23 oscillates axially during successive pressure and suction portions of the pumping cycle as the lever continues to be operated in the limit condition since continuous communication is provided between the fluid at the pump and that in recess 112.

The release of pressure on piston 23 is accomplished by the operation of a release valve assembly 300 which will now be described.

The release valve assembly 300 is disposed within a recess 302 which may conveniently be formed by boring in housing 10 as an extension of fluid chamber 60. Recess 302 is formed of first, second and third sections 304, 306 and 308 of differing diameters arranged such that section 304, lying adjacent to chamber 60, has the largest diameter while intermediate section 306 has the next largest diameter and forward-most section 308 has the smallest diameter. A plug 310 which threadably engages section 304 and a seal 305 provide a high pressure seal between chamber 60 and the remainder of recess 300, thereby providing a total separation between the valve assembly and fluid chamber 60.

Portion 308 of recess 300 communicates with pressure chamber 112 via a conduit 312. The movable member 314 of valve assembly 300 is a shaft configured to define first and second sections 316 and 318. Section 316 has a larger diameter than section 318 and section 316 moves in section 306 of recess 302 while section 318 moves mainly in section 308 of the recess. A compression spring 320 is disposed between plug 310 and section 316 of moving member 314 for urging member 314 forwardly into recess section 308.

Sections 316 and 318 are joined by a tapered portion 319 which seats against a shoulder 321 defined by adjacent sections 306 and 308 of recess 302. Thus urging of spring 320, in the absence of countervailing forces, causes tapered portion 319 to sealingly seat against shoulder 321.

Figure 5:
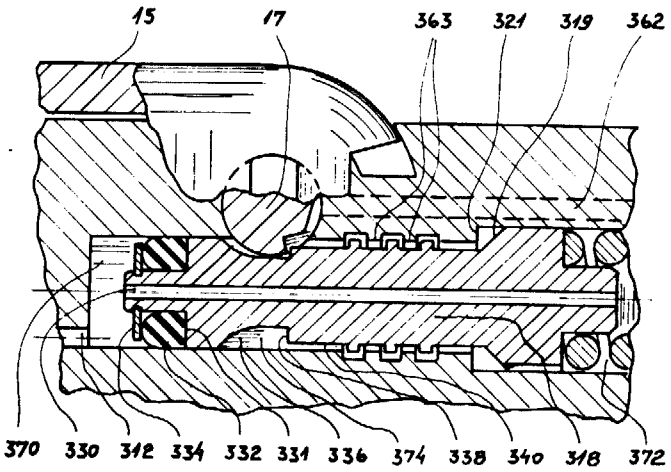
FIG. 5 is a detailed illustration of the release valve of FIG. 4 arranged in an open position.
Figure 4:
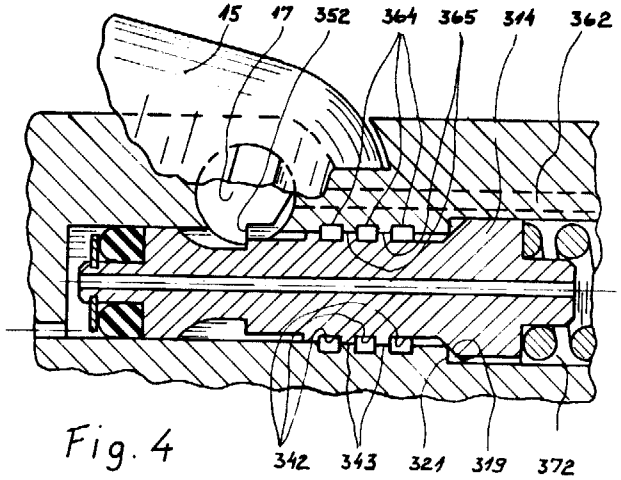
FIG. 4 is a detailed illustration of the release valve incorporated in the embodiment of FIGS. 1 and 2 arranged in a closed position.

Referring now additionally to FIGS. 4 and 5, the detailed configuration of movable member 314 will now be considered. Large diameter portion 316 and small diameter portion 318 form a unitary element having an axial bore 330 extending therethrough. At the extreme inward end of portion 318 in a recess 331, there is provided a high pressure low friction seal 332 retained in position with respect to portion 318 by a retaining ring 334.

Adjacent seal 332 there is defined a tapered angular recess 336 which terminates in a shoulder 338 and communicates with a shallow recess 340. Intermediate shallow recess 340 and tapered portion 319 there are formed a number of relatively spaced uniform annular recesses 342 separated from each other and from recess 340 by separation 343. The width of recesses 342 along the longitudinal axis of member 314 exceeds the width of the separation therebetween and exceeds the width of the separation between shallow recess 340 and the adjacent recess 342.

Figure 6:
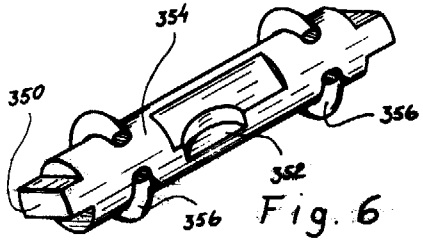
FIG. 6 is a pictorial illustration of a pivot member forming part of the release valve of FIGS. 4 and 5.

Reference is now made additionally to FIG. 6 which shows a pivot member 350 formed with an interior notch 352 which engages shoulder 338 and exterior protrusions which engage lever 15. Pivot member 350 comprises a generally cylindrical body 354 surrounded at opposite ends by peripheral low pressure ring seals 356 so as to prevent the leakage of hydraulic fluid from the vicinity of the center of body 354 to the outside of the tool. Pivot 350 is located in a recess 360 formed in housing 10, the interior of which is in communication with fluid chamber 60 via a bore 362.

Pivot 350 is coupled to lever 15 such that depression of lever 15 causes rotation of pivot 350 about axis 17 with the consequence that notch 352 which engages shoulder 338 is pushed in a direction opposing the force exerted by spring 320.

Portion 308 of recess 300 is configured to have a plurality of spaced peripheral angular recesses 364 and separation 363 formed therein of width and spacing substantially identical to that of recesses 342 and separations 343 formed in member 314. Recesses 364 are positioned such that the recesses and separations are aligned thus defining common mating surfaces 365 which thus produce resistance to fluid flow, when tapered portion 319 is in spring-urged engagement with shoulder 321 and lever 15 is in its unactuated position. It is appreciated that the outer diameter of portion 318 and inner diameter of portion 308 must be fabricated to relatively high tolerances such as 5 microns in order to provide the desired resistance to fluid flow.

FIG. 4 shows relative orientation of member 314 in recess 300 when pressure release lever 15 is not depressed and respective recesses 342 and 364 are in alignment. In such an orientation three chambers are defined. The first, indicated by reference numeral 370, lies beyond high pressure seal 332 and in fluid communication with chamber 112 which is under high pressure when piston 23 is extended. The second, indicated by reference numeral 372, lies within recess portion 306 and is also maintained at high pressure due to the fluid communication afforded through bore 330, providing pressure equalization between chambers 370 and 372. The third chamber 374 is located at recesses 336 and 340 and communicates via bore 362 with fluid chamber 60. When the apparatus is oriented as shown in FIG. 4, no fluid communication between chamber 374 and either of chambers 370 and 372 exists.

It is the function of release valve assembly 300 to release relatively high hydraulic pressure built up behind piston 23 at a time and at a rate controllable by an operator with the action of a single hand, unassisted.

It is appreciated that the provision of fluid communication bore 330 effectively balances the axial forces acting on element 314 such that the net axial force acting thereon is that exerted by spring 320 urging tapered portion 319 against shoulder 321.

It has been found in practice that a slight increase in the effective diameter of the contact seal at shoulder 321 which occurs during use gives rise to additional small forces codirectional with the axial force exerted by spring 320 which further improves sealing action.

The depression of lever 15 causes pivot 350 to rotate thereby pushing member 314 against the force exerted by spring 320. As a result, tapered portion 319 is unseated from shoulder 321 permitting fluid to leak from pressure chamber 372 to chamber 374 at a rate governed by the resistance to fluid flow of the groove system. If lever 15 is only slightly depressed, grooves 364 and 342 are virtually aligned and the fluid must leak through mating surfaces 365. If a faster release is required by the operator, lever 15 is further depressed thereby diminishing the extent of the mating surfaces and thus decreasing resistance to fluid flow. If lever 15 is fully depressed, grooves are completely non-aligned and fluid can flow virtually without resistance.

As noted earlier, chamber 374 is in fluid communication with fluid chamber 60 permitting drainage of hydraulic fluid thereto and release of pressure behind piston 23.

It is appreciated that the amounts of hydraulic fluid employed in the tool described hereinabove are relatively small and thus the system has the characteristics of a hydrostatic system rather than a hydrodynamic one. As a result in conventional hydraulic tools, release of pressure produces a jolt.

The particular construction of release valve described hereinabove in which the relatively high pressure exerted on the valve is in effect cancelled out enables the valve to be operated with the exertion of relatively little force, permitting one hand operation of the tool. At the same time, the operator is provided with full control over the rate of pressure release and can terminate pressure release at any intermediate stage. As a result the jolt which is characteristic of prior art hydraulic tools need not be present in the embodiment described. Furthermore the sharp and sudden release of pressure produced in prior art mechanisms is obviated.

Figure 7:
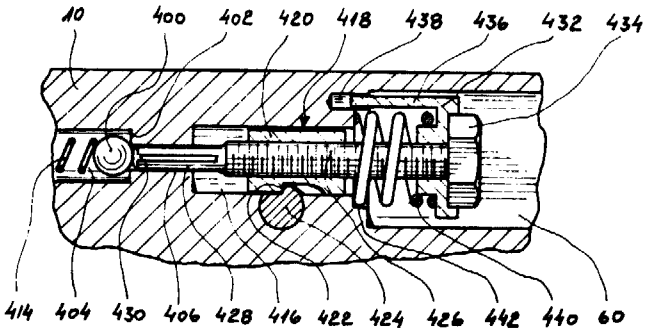
FIG. 7 is a sectional side view illustration of an alternative embodiment of a release valve for a single hand held tool constructed and operative in accordance with an embodiment of the invention.

Reference is now made to FIG. 7 which shows an improved release valve especially adapted for use in association with a single-hand held tool cutting mechanism. The remainder of the tool is substantially the same as or analogous to the single-hand operated tools described hereinabove and will not be particularly described herein.

The release valve comprises a ball 400 which seats against a shoulder 402 defined within housing 10 between a recess 404 and a channel 406.

Recess 404 communicates with a pressure chamber (not shown) associated with a movable piston (not shown). A compression spring 414 disposed within recess 404 urges ball 400 into a seating orientation against shoulder 402. A recess 416, typically formed by boring as a continuation of fluid chamber 60 is in fluid communication, via channel 406, with recess 404. Disposed within recess 416 is a valve ball dislodgement mechanism indicated generally by reference numeral 418 and comprising a bushing 420 formed with a notch 422 which is engaged by a notched pivot member 424 which is similar in all relevant respects to the pivot member illustrated in FIG. 6. Pivot member 424 is coupled to a release lever (not shown).

A threaded dislodgement shaft 426 threadably engages bushing 420 through a threaded bore formed therein and comprises a forward fluted portion 428 which travels within channel 406 and whose tip 430 selectably engages ball 400 for dislodgement thereof from shoulder 402 thus opening the valve defined thereby and permitting the flow of hydraulic fluid from the pressure cylinder into fluid chamber 60 via conduit 406 and recesses 404 and 416.

In the past considerable expense was involved in machining rod 426 to precise tolerances so as to insure that (1) in a rest position tip 430 did not dislodge the ball 400, and (2) that an undue amount of forward travel was not required to dislodge ball 400 as desired. This problem and the accompanying problem of accuracy due to wear are overcome herein by making the axial position of tip 430 with respect to the pivot point of pivot 424 selectable by selectable threading of rods 426 and bushing 420.

Inadvertent rotation of rod 426 is prevented by a lock washer 432 which engages the head 434 of rod 426 so as to prevent relative rotation between washer 432 and head 434. Bushing 420 cannot rotate due to the interlocking relationship thereof with pivot 424. Washer 432 also includes an arm 436 which seats in a recess 438 formed in housing 10 thus preventing rotation of the lock washer relative to the housing. The lock washer is maintained in engagement with head 434 by means of a compression spring 440 which seats in an angular recess 442 formed in housing 10 and against lockwasher 432. Spring 440 operates to return the release valve assembly to its sealed position.

It may thus be appreciated that initial adjustment of the position of rod 426 is such that when the pressure release lever (not shown) is not engaged, tip 430 of rod 426 touches or nearly touches ball 400 but does not dislodge it. However, it is sufficiently close so as to minimize the forward travel of tip 430 required for dislodging ball 400 and thus opening the valve and releasing the pressure in recess 404.

Figure 9A:
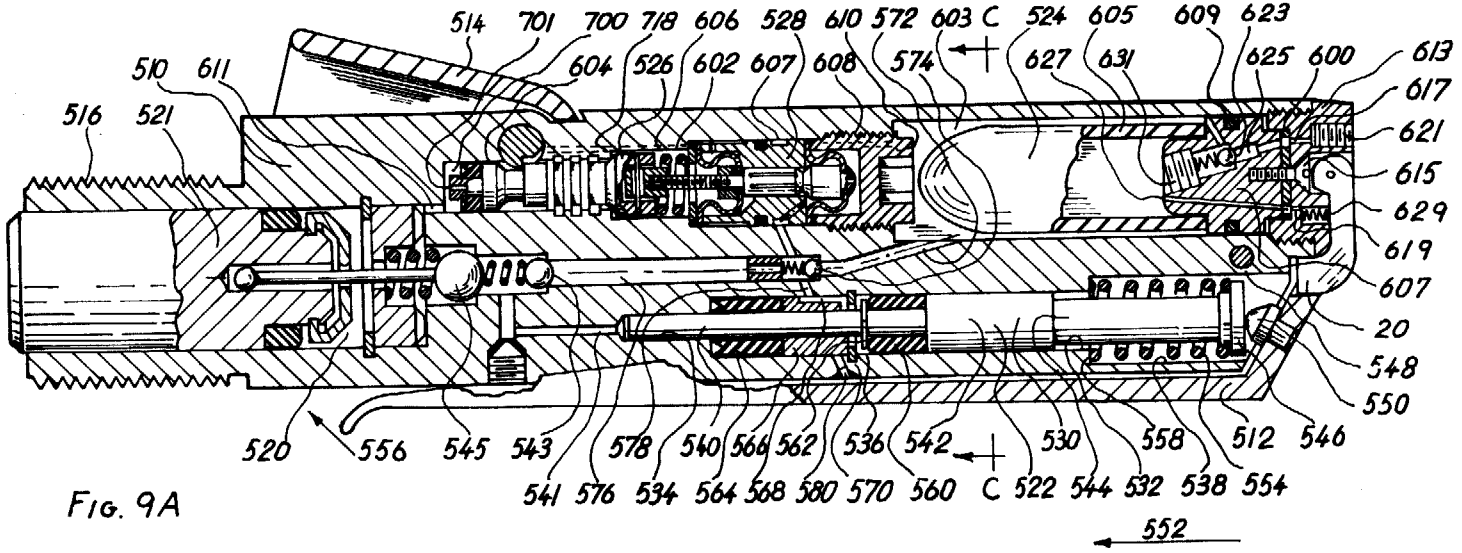
FIG. 9A is a schematic side view sectional illustration of a multipurpose single hand operated tool constructed and operative in accordance with an embodiment of the invention.
Figure 9C:
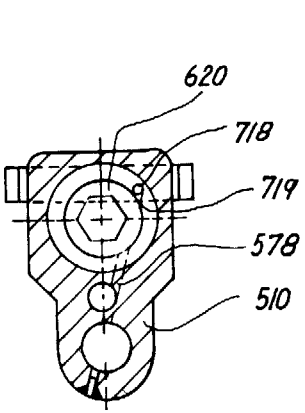
FIG. 9C is a sectional illustration taken along the lines C—C in FIG. 9A.
Figure 9B:
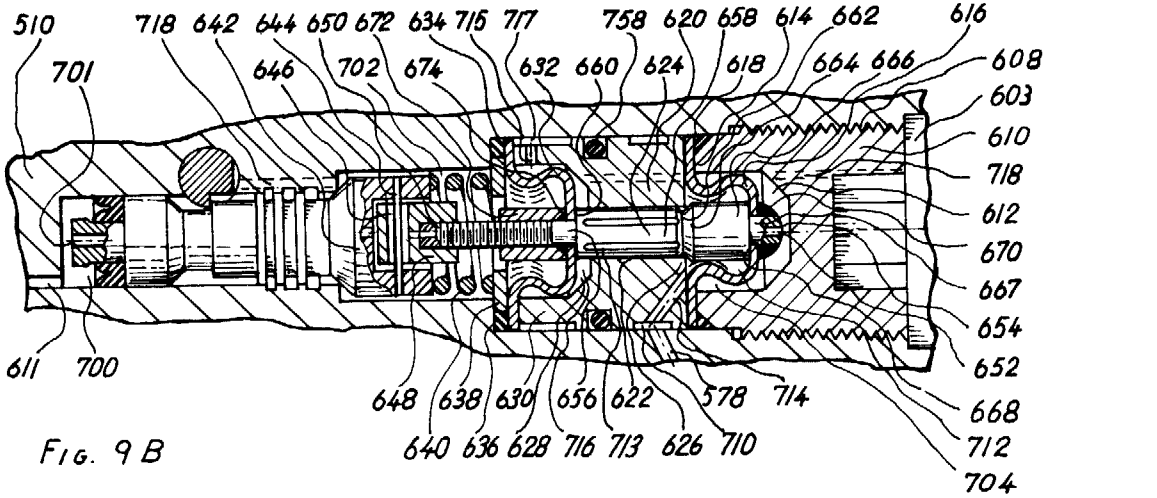
FIG. 9B is a detailed sectional illustration of the release valve and two-speed valve apparatus shown in FIG. 9A.

Reference is now made to FIGS. 9A, 9B and 9C which show a single hand operated tool constructed and operative in accordance with a preferred embodiment of the invention. The single-hand operated tool comprises a housing 510 having pivotably attached thereto a pump handle 512 and a release valve handle 514. The front end 516 of the tool is threaded to accommodate a selectable tool head, such as a crimper, cutter or wrench.

Generally speaking the tool comprises a hydraulic cylinder 520 and piston 521, a pump assembly 522, a reservoir assembly 524, a release valve assembly 526 and a two speed valve and automatic release assembly 528. The two speed valve, automatic release and pump assemblies are the primary subjects of the present description which follows and the claims herein along with an improved reservoir assembly.

There is described hereinabove in connection with FIGS. 1–8 a single-hand operated tool comprising all of the above elements with the exception of the pump assembly, the two speed valve and the automatic release assembly. The embodiments described hereinbelow represent an improvement of the single-hand operated tool described hereinabove.

Pump assembly 522 comprises an elongate piston 530 sealingly disposed in a bore 532, typically of circular cross section, formed in housing 510. Bore 532 comprises a forward section 534 of relatively small cross sectional diameter, an intermediate section 536 of larger diameter and a rearward section 538 of even larger diameter. Typical diameters of the bore cross sections are 5, 9, and 13 mm respectively.

Piston 530, similarly to bores 532, is made of a plurality of sections of differing cross sectional areas. Preferably piston 530 is integrally formed of a forward portion 540, an intermediate portion 542 and an end portion 544. Typical cross sectional diameters of the respective portions are 5, 9 and 8 mm, respectively. The end portion 544 of the piston is provided with a spring retaining rim 546.

Pump assembly 522 is operated by pump handle 512 which is pivotably mounted about an axis 548 fixed in the housing. A contact pin 550, attached to pump handle 512 at the rearward end thereof, engages the rear end of piston 530, forcing it forward in a direction indicated by an arrow 552 against the urging of a spring 554, seated in bore section 538, when the pump handle is forced towards the housing 510 in a direction indicated by an arrow 556. It is to be appreciated that the pumping action of handle 512 can be readily produced by grasping the entire tool with a single hand and forcing the hand closed periodically in order to move handle 512 in direction 556.

Spring 554 is seated between a forward ridge 558 at the front of bore section 538 and retaining rim 546. Disposed forwardly of intermediate piston portion 542, which sealingly engages bore section 536, is packing 560 which is retained in place against piston portion 542 by a retaining ring 562 attached to forward piston portion 540. Forward piston portion 540 is surrounded by packing 564 at the front of bore section 536. Rearwardly of packing 564 is a sleeve 566 which supports packing 564 and provides a hydraulic fluid communication pathway 568 communicating with the interior of bore section 536, forwardly of packing 560. A retaining ring 570 seated in housing 510 retains the packing 564 and sleeves 566 in their respective positions.

A hydraulic fluid pathway 572 communicates between hydraulic fluid reservoir assembly 524 and a one-way valve 574. One-way valve 574 typically comprises a spring biased ball which only permits fluid flow from the reservoir to a hydraulic fluid conduit 576 communicating with valve 574. Fluid communication pathway 568 communicates with conduit 576 via a narrow conduit 578. Conduit 578 also establishes hydraulic fluid communication with the two-speed valve and automatic release assembly 528. In practice conduit 578 is bored from the outside of housing 510 as a straight angled bore and is sealed at its external terminus 580. The orientation of conduit 578 is illustrated in FIG. 9C.

The release valve assembly 526 and the two speed valve and automatic release assembly 528 are disposed within a recess 602 which may be formed conveniently by boring in housing 510 as an extension of a fluid chamber 603, forming part of reservoir assembly 524. Recess 602 is formed of first, second and third sections 604, 606, and 607 of differing diameters and a threaded portion 608 arranged such that the threaded portion 608 lies intermediate chamber 603 and section 607 having the largest diameter and in which the two speed valve and automatic release assembly is primarily located. Section 604 has the smallest diameter and is the forwardmost of the sections, while section 605 has an intermediate diameter and lies between sections 604 and 607.

A plug 610 threadably engages threaded portion 608. Plug 610 defines a forward-facing recess 612 which terminates at a forward edge rim 614. A relatively thin metal diaphragm spring 616 is sealingly mounted along its periphery in recess section 607 between high pressure sealing material 618 such as nylon or copper disposed along rim 614 and a stationary valve member 620.

Stationary valve member 620 is formed with a central bore 622 in which is disposed a valve stem 624 for longitudinal movement relative thereto. The peripheral rearward edge of bore 622 facing diaphragm spring 616 defines a valve seat 626 for stem 624. Central bore 622 terminates in a forward facing recess 628 which terminates at a forward edge rim 630.

A second relatively thin metal diaphragm spring 632 is mounted between rim 630 and a high pressure sealing rin 634, formed of a suitable material such as nylon or copper. Sealing ring 634 is seated on a shoulder 636 defined by housing 510 at the junction of second and third recess sections 606 and 607. Disposed interiorly of sealing ring 634 is a centrally perforated washer 638. Washer 638 serves as a support for a spring 640 mounted between the rearward facing end of a release valve stem 642 and washer 638. Diaphragm springs 616 and 632 are typically formed of spring steel of thickness 0.5-0.8 mm in a generally bell shape as illustrated. It is a particular feature of the present invention that the diaphragm springs serve at the same time as pressure seals and as springs and are effective to overcome the problems of small size, high capacity spring design described hereinabove.

The release valve assembly, including release valve stem 642 are essentially identical in structure and operation to release valve assembly 300 described hereinabove in connection with FIG. 2, except for a connection to the valve assembly 528 which will now be described. For this reason, the release valve assembly 526 will not be described herein detail, except insofar as it differs from release valve assembly 300. The rear portion of stem 642 is provided with a transverse pin 644 which is rigidly mounted onto stem 642. Pin 644 engages an elongate slot 646 formed in a connecting member 648 which is threadably joined to a threaded portion 650 of valve stem 624. The position and length of slot 646 are determined to permit sufficient play of the pin in the slot so as to allow manual operation of the release valve by depression of lever 514 without operation of valve assembly 528. Similarly the slot configuration defines a threshold for rearward movement of stem 624 in response to pressure buildup until pin 644 engages the forward edge of slot 646 and pulls stem 642 rearwardly, thus unseating it and producing immediate pressure release.

Valve stem 624 will now be described in detail. Valve stem 624 is a generally longitudinal member having a central longitudinal fluid passage 652 extending entirely therethrough from the forward end of the threaded portion 650 to the extreme rearward end thereof, indicated by a reference numeral 654.

The threaded portion 650 is of relatively small diameter, typically 4 mm and is followed by a smooth section 656, typically 4 mm in length and of outer diameter of 4 mm which terminates in a generally fluted portion 658 of larger outer diameter typically 6 mm, and thus defining a shoulder 660 between portions 656 and 658. Portion 658 terminates in a short conical section 662 of decreasing outer diameter which in turn terminates in a slightly longer conical section 664 of increasing outer diameter. Portion 664 extends rearwardly into a smooth portion 666 of slightly larger outer diameter than portion 658. The rearward extension of portion 666 is a short smooth portion 667 of relatively small outer diameter, such as 5 mm. A shoulder 668 is defined between sections 666 and 667.

Diaphragm spring 616 is mounted onto valve stem 624 against shoulder 668 by welding. The weld, illustrated by reference numeral 670 provides a high pressure seal between volumes rearward and forward of the diaphragm 616. Conical section 664 is positioned to sealingly seat against shoulder 626 at equilibrium and to unseat when the differential pressure in the valve assembly forces the valve stem 624 rearwardly of its equilibrium position against the spring force of the diaphragm springs. The details of the operation of the valve assembly will be described hereinbelow following completion of the structural description thereof Diaphragm spring 632 is sealingly attached to valve stem 624 by means of a nut 672 which is threaded onto threaded portion 650 forcing diaphragm 632 against shoulder 660. Sealing material 674 is provided between the nut and the diaphragm to provide a high pressure seal across the diaphragm, and the nut is additionally sealed to the threaded portion 650 by a sealing material such as Locktite in order to prevent opening of nut 672.

Diaphragm 632 is constructed to be larger than diaphragm 616 and to have a pressure receiving cross sectional area which is larger than that of diaphragm 616 by 3-5%. It may thus be appreciated that the valve assembly 528 comprises a differential valve which is operative in response to the difference is pressures produced by the difference in the pressure receiving cross sectional areas of the respective diaphragms.

It is a particular feature of the present invention that the use of a differential fluid valve enables control of high pressures to be achieved with relatively small size components and relatively low capacity springs.

The fluid connections of the valve assembly and between the valve assembly and the remainder of the tool will now be described in detail.

Hydraulic fluid at operating pressure in cylinder 520 communicates via a conduit 611 with a volume 700 lying in front of release valve stem 642. The hydraulic fluid at operating pressure also communicates with a volume 702 in the vicinity of threaded portion 650 and forwardly of diaphragm 632 via the center passageway 701 in valve stem 642. Hydraulic fluid at operating pressure also communicates from volume 702 via central longitudinal passageway 652 to a volume 704 located rearwardly of diaphragm 616. These are the only volumes in the two speed valve assembly 528 which are maintained at the operating pressure, which during operation against a resistance may reach high pressures in the range of 10,000-20,000 psi.

It is noted that the operating pressure operates rearwardly against forward diaphragm spring 632 and forwardly against rearward diaphragm spring 616. Thus movement of the valve stem which is fixed to both diaphragm springs is a function of the difference in pressure receiving areas of the two diaphragm springs. As the operating pressure increases, this difference increases, urging the valve stem against the spring force exerted by the diaphragm springs in a rearward direction by an amount which is a function of the operating pressure level. At a predetermined operating pressure level, typically 5000 psi, the rearward movement of the valve stem causes conical section 664 to unseat from shoulder 626. The implications of the opening or closing of this valve will be better understood from the description of the relatively low pressure hydraulic fluid pathways which follows:

Conduit 578, which, as described hereinabove, communicates with the relatively high volume, low pressure pump portion of the pump assembly 522, communicates with a peripheral recess 710 formed in member 620 of the two-speed valve assembly. Recess 710 communicates with a volume 712 forward of diaphragm 616 via a conduit 714 drilled in member 620. Volume 712 communicates with a volume 716 rearward of diaphragm 632 via fluted grooves 713 formed in portion 658 and via the valve defined by conical portion 664 and shoulder 626 when the valve is open. Volume 716 communicates via conduit 715, annular recess 717 and a conduit 719 drilled in body 510 with a low pressure fluid drain conduit 718 connected to the hydraulic fluid reservoir 603.

As may be appreciated by reference to FIG. 9C, conduit 719 is actually an extension of a drilled bore which defines conduit 578. As seen in FIGS. 9A-9C, the bore is a straight bore which is angled in two perpendicular planes. Conduit 719 is permanently sealed from conduit 578 by stationary valve member 620 and by a sealing ring 758, which will be described hereinafter. It is noted that in FIG. 9A the entire length of the bore is shown, partially in dotted lines, for purposes of clarity and completeness of description, notwithstanding that the lower portion thereof should not appear in the illustrated section. The correct disposition of the bore is shown in FIG. 9C.

It may be appreciated that when the valve stem 624 is so positioned such that conical portion 664 is unseated from shoulder 626, hydraulic fluid pumped via conduit 578 is drained back to the fluid reservoir, producing no pressure buildup and not contributing to operation of the tool. The force applied to the pump via pin 550 is now effectively applied to the smaller diameter forward piston portion 540 alone.

In order that the operation of the two-speed and automatic release valve assembly be fully understood, the operation of the tool illustrated in FIGS. 9A, 9B and 9C will now be described in detail. For the sake of simplicity, the reference numerals used with respect to the parts of the tool not specifically described with reference to FIGS. 9A, 9B and 9C will be those used in connection with FIG. 2 hereinabove.

Operation of the tool is commenced by releasing catch member 20, by a slight pressure on handle 512, thus freeing the handle. The action of spring 554 urges handle 512 outwardly with respect to housing 510 in a direction opposite to that indicated by arrow 556. The action of spring 554 also causes piston 530 to move rearwardly in a direction opposite to that indicated by arrow 552. This motion produces suction at two places, at the volume in front of piston 542 communicating with conduit 578 and at the volume forward of piston 540 communicating with channel 541. The suction produced at conduit 578 causes ball valve 574 to open, drawing fluid from reservoir 603 via channel 572 into the volume in front of piston 542. Similarly the suction produced at channel 541 causes check valve 543 to open and draws fluid to the volume forward of piston 540 via conduit 572, check valve 574, conduit 576, check valve 543 and conduit 541.

Following the suction portion of the pumping cycle, squeezing of the handle 512 against the housing 510 in a direction indicated by arrow 556 causes piston 530 to be forced in a forward direction indicated generally by arrow 552 in response to urging of contact pin 550. Two simultaneous pumping operations occur. The first, a high volume, low pressure pumping operation, is produced by piston 542 which forces hydraulic fluid via conduit 578 into chamber 576.

One way valve 574 prevents return of the fluid via conduit 572 to the reservoir. Since the two speed valve is closed, i.e. conical portion 664 is seated against shoulder 626, appreciable amounts of hydraulic fluid are forced through conduit 576 and past check valves 543 and 545 to chamber 520, thus forcing piston 521 outwardly with respect to the housing.

It is noted that the low pressure exerted on diaphragm 616 is insufficient to cause unseating thereof due to the presence of corresponding countervailing pressure on the opposite side of the diaphragm.

The second pumping operation is produced by piston 540 which, being of relatively smaller cross sectional area than piston 542, provides a relatively low volume flow of hydraulic fluid through conduit 541 and past check valve 545 to cylinder 520. The two pumping operations produce an additive result. The two operations continue simultaneously as the piston is urged forwardly against an increasing load, such as when the piston operates a crimper, until the pressure in cylinder 520 reaches a predetermined pressure level, typically 5000 psi. At this predetermined selectable pressure level, the pressure in cylinder 520 which also appears, as noted above, at volumes 700, 702 and 704, overcomes the spring force exerted by the diaphram springs and causes the valve stem to move rearwardly by an amount sufficient to cause conical portion 664 to become unseated from shoulder 626.

When the two speed valve is thus opened, hydraulic fluid pumped by piston 542 via conduit 578 is permitted to pass via volume 712, the fluted grooves 713 in stem portion 658, volume 716, conduit 715, recess 717 and conduit 719 to hydraulic fluid reservoir drain 718 and to return to the hydraulic fluid reservoir 603. As a result, no hydraulic fluid pumped by piston 542 passes through conduit 576 and reaches cylinder 520. Thus the high volume low pressure pumping operation is effectively short circuited and makes no contribution to the operation of the tool. Further pumping results only in pumping by piston 540 via conduit 541.

It may thus be appreciated that the opening of the two way valve at the predetermined threshold pressure shifts the tool from high speed operation to low speed, high pressure operation.

A continuation of the pumping action produces increased pressure in cylinder 520. When this pressure reaches a second higher pressure threshold, typically 20,000 psi, the rearward movement of valve stem 624 is sufficient such that pin 644 engages the forward edge of slot 646 and the continued rearward movement of member 648 pulls release valve stem 642 rearwardly so as to at least partially unseat the release valve, providing a significant immediate pressure drop in cylinder 520. In cases where the valve stem is fully unseated by this action, the pressure drop is down to the reservoir pressure. Alternatively partial unseating produces a partial but significant pressure drop which, by producing a jolt, serves to indicate to the user that a predetermined pressure has been reached.

Once the pressure in cylinder 520 is released either by automatic operation of the device described hereinabove or by manual operation of the release valve via lever 514, the two-speed valve also closes. Further pumping at this point produces high volume, high speed operation until the first pressure threshold is again reached.

Reference is now made particularly to FIG. 9A in connection with which there will now be described a reservoir filling structure constructed and operative in accordance with an embodiment of the invention. Disposed within fluid chamber 603 is an elastic bladder 605 whose open end is sealingly mounted on a mounting nipple member 607. Member 607 is in turn sealingly mounted within chamber 603 by means of packing 600 and a sealing ring 609, and is attached to an external plug 613 by means of a screw 615. Plug 613 removably and threadably engages housing 510 and is formed with first and second conduits, 617 and 619. Conduit 617 is sealed by a removable threaded plug 621 and communicates via a ball valve 623 with the interior of fluid chamber 603 via a bore 625 to permit filling thereof without requiring removal of plug 613. Ball valve 623 prevents backflow of hydraulic fluid into bore 625 and conduit 617. Conduit 619 communicates with the interior of bladder 605 via a conduit 627 formed in member 607 and with the outside atmosphere, so as to maintain the interior of the bladder at atmospheric pressure so as to enable it to exert pressure on the hydraulic fluid in chamber 603, which is initially inserted thereinto via conduit 617 at greater than atmospheric pressure. Packing 600 prevents leakage of fluid during filling.

Conduit 619 defines a seat for a spring 629 which normally urges catch 20 outwardly. Valve 623 is mounted on a plug 631 which seals conduit 625 and the fluid containing volume of chamber 603 from the interior of the bladder 605.

Reference is now made to FIGS. 10A, 10B and 10C which illustrate a single hand held and operated cutting or crimping tool constructed and operative in accordance with an alternative embodiment of the invention. Briefly stated, the difference between the two speed valve assemblies in the presently described embodiment and the embodiment previously described in connection with FIGS. 9A–9C is in the direction of motion of the valve stem. In the present embodiment, the direction of travel of the valve stem in response to increasing pressure is in a direction indicated generally by an arrow 790, opposite to the direction of travel of the valve stem 624 of the earlier described embodiment under the same circumstances.

There are also various other differences in the structure of the tool illustrated in FIGS. 10A, 10B and 10C which will be specifically described herein. Other portions of the tool are substantially identical to corresponding portions of the tool illustrated in FIGS. 9A–9C. For the sake of conciseness, these portions will not be described once again but will be identified by the reference numerals used for corresponding portions in the embodiment of FIGS. 9A–9C.

The cutting or crimping tool comprises a housing 800 defining a fixed jaw portion 802 and a movable jaw portion 804 which is pivotably mounted onto housing 800 by means of a mounting pivot 806. A spring 808, which is normally maintained in tension, is connected at one end to the housing by a fastener 810 and at its opposite end to a retaining pin 812 fixed to the movable jaw portion 804. The function of the spring is to urge the movable jaw portion 804 into an open position.

Operating against the urging of spring 808 and urging the movable jaw portion into a closed orientation is a hydraulic piston 814 which moves in a hydraulic cylinder 820. Hydraulic piston 814 is provided with a high pressure seal packing 818 which is held in position relative to the piston by a retaining pin 816.

Hydraulic fluid from a pump assembly 824, which is identical in all relevant respects to assembly 522 of FIG. 9A, communicates with hydraulic cylinder 820 in a manner substantially similar to the fluid communication between the pump assembly 522 and cylinder 520 (FIG. 9A), and therefore will not be described once again. Similarly the hydraulic fluid supply to the two speed valve assembly via conduit 578 is substantially identical in the two embodiments and need not be described once again. The construction of the two speed valve, however, in the present embodiment does differ from that in the embodiment of FIGS. 9A–9C and will now be described in detail.

The release valve assembly 826 and the two speed valve assembly 828 are disposed within recess 832 which may be formed conveniently by boring in housing 800 as an extension of a fluid chamber 803 forming part of a reservoir assembly 524. Recess 832 is formed of first, second and third sections 834, 836, and 837 of differing diameters and a threaded portion 838 arranged such that portion 838 lies intermediate chamber 803 and section 837, having the largest diameter and in which the two speed valve assembly is primarily located.

Section 834, of intermediate diameter, is the forwardmost of the sections while section 836 has the smallest diameter and lies between sections 834 and 837. A plug 840 threadably engages threaded portion 838. Plug 840 defines a forward facing recess 842 which terminates at a forward edge rim 844.

A relatively thin metal diaphragm spring 846, similar in all relevant respects to the diaphragm springs employed in the embodiment of FIGS. 9A–9C, is sealingly mounted along its periphery in recess 842 between high pressure sealing material 848, such as nylon or copper, disposed along rim 844 and a stationary valve member 850. A sealing ring 851 is disposed in a recess 853 formed in valve member 850 alongside the peripheral edge of diaphragm spring 846 to provide a medium pressure seal.

A sealing ring 868 is disposed in a recess formed in valve member 850 to seal the medium pressure volume communicating with conduit 578 from a recess 923 maintained at low pressure.

Stationary valve member 850 is formed with a central bore 852 extending longitudinally therethrough and in which is disposed a valve stem 854 for longitudinal motion relative thereto. The rearward facing surface of the stationary valve member peripheral of bore 852 defines a conical section 855. Central bore 852 terminates in a forward facing recess 858 and defines thereat a shoulder 860 which serves as a valve seat for stem 854 as will be described in greater detail hereinafter.

Recess 858 terminates at a rim 862. A second relatively thin metal diaphragm spring 863, substantially similar to spring 846 but of smaller size and cross sectional area is mounted between a pair of sealing rings 864 and 865 providing a medium pressure seal and a high pressure seal respectively and formed of suitable materials such as nylon, copper or polyurethane. Sealing ring 864 is seated against rim 862 while sealing ring 865 is seated in a recess 866 defined by housing 800 at the junction of second and third recess sections 836 and 837.

The release valve assembly 826 will now be briefly described: The release valve assembly comprises a valve stem 861 which is selectably seatable against a shoulder 863 defined at the junction of recess sections 834 and 836. The valve stem 861 will be described from its forward end, i.e. that facing cylinder 820 to its rearward end in a sequential manner. At the forward end of valve stem 861 is a cylindrical portion 865 of relatively small cross sectional diameter, followed by a cylindrical portion of larger diameter 867 and followed by a conical portion 869 of decreasing cross sectional diameter, which selectably engages shoulder 863 to provide seating and thus sealing of the valve.

Following portion 869 is a short conical portion 871 of increasing cross section followed by a fluted cylindrical portion 873 having longitudinal grooves 875. Following portion 873 there is a cylindrical portion 877 of relatively small cross section followed by a short conical portion 879 of increasing cross section, a cylindrical portion 881 and a small diameter cylindrical portion 883.

The entire valve stem is provided with a longitudinal passage extending entirely therethrough and indicated by a reference numeral 912. A spring 887 is seated between cylindrical portion 867 and a perforated bulkhead member 889 which provides fluid communication between cylinder 820 and recess portion 834. Bulkhead member 889 is securely mounted at the rear of cylinder 820 by means of a retaining ring 891. Spring 887 normally urges the valve stem 861 rearwardly into seating engagement against shoulder 863.

The outer diameters of cylindrical portions 873 and 881 are nearly equal to the inner diameter of recess section 836. Low friction packing material 893 is provided about cylindrical portion 883 to provide a high pressure seal between the volume rearward thereof and the volume surrounding cylindrical section 877, which communicates with a reservoir drain 921 via a space in bore 895 in which is disposed the manual operating member 897 associated with the release valve.

The rearward facing edge of cylindrical portion 883 serves as a contact surface which is impacted by the two-speed valve at its maximum travel for automatic operation of the release valve.

The valve stem 854 of the two speed valve assembly will now be described in detail. The valve stem 854 is a generally longitudinal member having a central longitudinal passageway 882 extending entirely therethrough from a forward end 886 to an extreme rearward end thereof 888. Forward end 886 is a cylindrical portion of relatively small cross sectional diameter which engages a central aperture formed in diaphragm spring 863. Spring 863 is securely and sealingly mounted onto the forward end by means of a peripheral weld or braze 885 disposed forward of the diaphragm spring on the end 886.

Rearwardly of forward end 886 is a cylindrical portion 890 of relatively larger cross section and which is followed by a conical section 892 of decreasing diameter in a rearward direction. Conical section 892 sealingly engages valve seat 860 when the valve stem is positioned relatively rearwardly to close the valve. Rearwardly of section 892 is a conical section 894 of increasing diameter in a rearward direction. Section 894 is followed rearwardly by a generally cylindrical section 896 of diameter substantially equal to the inner diameter of bore 852 and having a plurality of longitudinal grooves or flutings on its surface to permit fluid communication therepast.

Section 896 is followed by a cylindrical section 898 of relatively small diameter and which is followed in turn by a generally cylindrical section 900 having the same diameter as section 896 and having longitudinal grooves on its surface and extending nearly to the rearward edge thereof. Rearwardly of cylindrical section 900 is a threaded section 902 which engages a central aperture in diaphragm spring 846. Diaphragm spring 846 is securely and sealingly attached to the valve stem by means of a nut 904 which threadably engages section 902 and by a sealing material 906 such as nylon which is compressed between the nut 904 and the spring 846. The nut is secured against rotation by a material such as Locktite.

Hydraulic fluid under pressure communicates from cylinder 820 via channel 910 and a longitudinal channel 912 formed in the valve stem of the release valve to a volume forward of diaphragm spring 863, and also via longitudinal passageway 882 formed in valve stem 854 to a volume rearward of diaphragm spring 846. Thus the hydraulic fluid pressure present in the cylinder 820 is exerted on the valve stem 854 in two opposite directions. Since, however, the cross sectional area of diaphragm spring 846 exceeds that of diaphragm spring 863, an increase in hydraulic fluid pressure in cylinder 820 causes a net force of increasing magnitude to be exerted on the valve stem in a direction indicated by arrow 790. An increase in the hydraulic fluid pressure in cylinder 820 above a predetermined threshold causes the valve stem 854 to overcome the resistance of the diaphragm springs and to move from its normally closed position in a direction indicated by arrow 790 and to unseat.

Hydraulic fluid at reservoir pressure from the pump assembly via conduit 578 communicates with a volume 914 rearward of diaphragm spring 863 via a conduit 916. Volume 914 communicates with an interior peripheral recess 922, adjacent small diameter valve stem section 898 via central bore 852 past shoulder 860 when the valve stem is not seated thereagainst and via fluted grooves 896. Recess 922 in turn communicates via a conduit 924 with a peripheral recess 923. Recess 923 is connected to the hydraulic fluid reservoir by hydraulic fluid return conduits 920 and 921.

Under conditions of low operating pressure, valve stem portion 892 is normally sealingly seated against shoulder 860, thereby preventing fluid communication between volume 914 and conduit 924. In such a case, the two speed valve assembly does not provide an outlet for fluid supplied along conduit 578 and the fluid thus pressurizes the cylinder 820. When the predetermined medium pressure threshold is reached, the valve stem moves forwardly and becomes unseated, thus permitting hydraulic fluid from conduit 578 to drain to the hydraulic fluid reservoir via conduit 916, volume 914, bore 852, conduit 924, recess 923, and conduits 920 and 921 and thus the hydraulic fluid pumped by the relatively high volume pump portion of the pump assembly does not serve to pressurize the cylinder.

When a predetermined high pressure threshold is reached, the forward end 886 of the valve stem 854 contacts edge 883 of the release valve stem, pushing it forward to partially or completely release the fluid pressure in cylinder 820.

Figure 11:
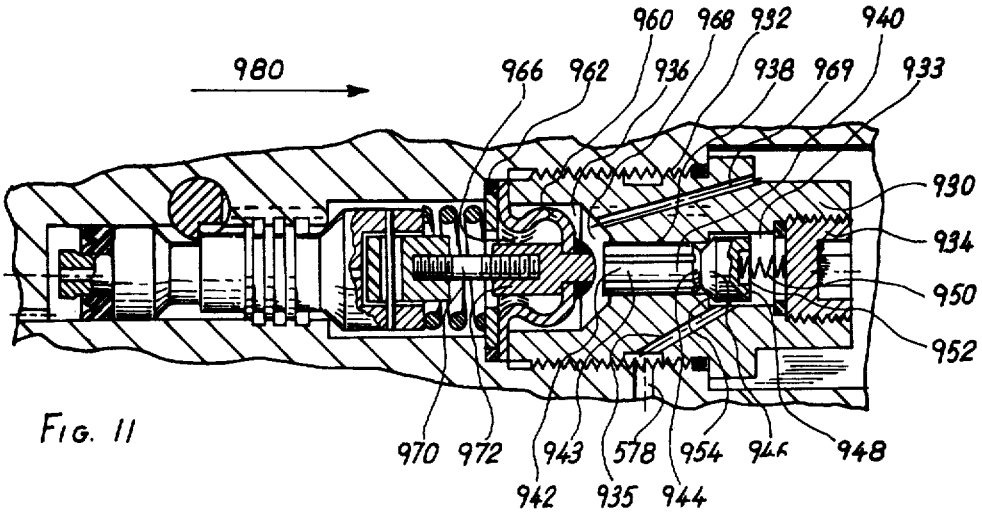
FIG. 11 is a detailed sectional illustration of a release valve and two-speed valve apparatus constructed and operative in accordance with an alternative embodiment of the present invention.

Reference is now made to FIG. 11 which illustrates the release valve and two speed valve assemblies of a single hand held and operated tool constructed and operative in accordance with an embodiment of the invention. In this embodiment, which is otherwise similar in all relevant respects to the embodiment of FIGS. 9A, 9B and 9C, the two speed valve assembly comprises a single diaphragm spring of thickness of the order of 1–1.2 mm. Briefly stated, a stationary valve member 930 defines a rearward facing recess 933 which is sealed by a threaded rear plug 934 which also serves as a spring support, as will be described hereinafter. Stationary valve member 930 also defines a forward facing recess 936 which is connected to recess 933 by a longitudinal cylindrical bore 938. A valve stem 940 comprising a forward fluted portion 942 comprising longitudinal grooves 943 followed by a conical portion 944 of decreasing diameter and then by a conical portion 946 of increasing diameter and a cylindrical portion 948 is disposed in bore 938. A compression spring 950, disposed between rear plug 934 and a mounting recess 952 formed in the rear of portion 948 normally urges conical portion 946 into sealed seating engagement against a shoulder 954 defined at the rearward edge of bore 938 and which serves as a valve seat.

A diaphragm spring 960 is sealingly disposed at its periphery between sealing rings 962 and body 930 so as to define a cylinder pressure volume 966 forwardly thereof in communication with the hydraulic cylinder of the tool and a relatively low pressure volume 968 sealed from volume 966 rearwardly thereof. A connecting rod 970 couples the center of the diaphragm spring to the release valve for automatic operation thereof in a manner substantially similar to that described in connection with the embodiment of FIGS. 9A, 9B and 9C. Rod 970 is coupled to the diaphragm spring by a sealing connector 972.

Hydraulic fluid pumped through conduit 578 communicates with recess 933 via a conduit 935. Volume 968 communicates with the hydraulic fluid reservoir via a conduit 969. Normally spring 950 causes the valve stem 940 to be seated against shoulder 954 preventing fluid communication between recess 933 and volume 968 and thus preventing drainage of the fluid pumped through conduit 578 back to the reservoir. However, as the hydraulic fluid in the hydraulic cylinder increases in pressure, diaphragm spring 960 and rod 970 move in a direction indicated by arrow 980 until a predetermined pressure threshold is reached when the rearward surface of connector 972 contacts the forward surface of valve stem 940 and forces it rearwardly out of seating engagement with shoulder 954. At this point fluid communication between recess 933 and the hydraulic fluid reservoir is provided via conduit 935, grooves 943, volume 968, conduit 969 and the hydraulic fluid pumped through conduit 578 is drained to the reservoir and does not contribute to pressurization of the hydraulic cylinder of the tool.

Figure 12:
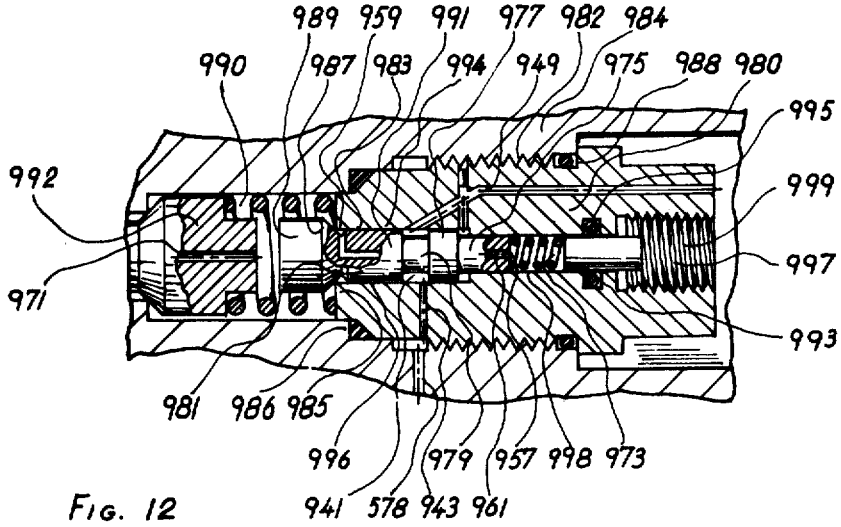
FIG. 12 is a detailed sectional illustration of two-speed valve apparatus constructed and operative in accordance with another alternative embodiment of the present invention.

Reference is now made to FIG. 12 which illustrates a two speed differential valve constructed and operative in accordance with an alternative embodiment of the invention. A stationary valve member 980 threadably and sealably engages a threaded portion 982 formed in a tool body 984 and is sealed with respect thereto by high pressure sealing material 986 and a medium pressure sealing ring 988. Portion 982 communicates with a bore 990 which corresponds to bore 606 in the embodiment of FIGS. 9A-9C. The rear end of a release valve 992 is illustrated. It is noted that the release valve is not operatively connected with the two speed valve assembly and thus automatic operation of the release valve is not provided.

The stationary valve member 980 is formed with a central bore 994 comprising a forward bore portion 996, an intermediate bore portion 998 of smaller cross sectional diameter than the forward bore portion and a threaded rearward bore portion 999. The peripheral edge of the forward bore portion 996 at the forward facing surface of the stationary valve member 980 defines a valve seat 985.

A threaded plug 997 sealingly engages bore portions 998 and 999, a medium pressure seal thereof being provided by a sealing ring 995 disposed in a recess 993 formed in the stationary valve member.

A valve stem 991 is disposed for seating engagement with forward bore portion 996 and intermediate bore portion 998. Valve stem 991 comprises a forward cylindrical portion 989 of diameter greater than that of forward bore portion 996, followed by a conical section 987 of decreasing cross sectional diameter in a rearward direction, which sealingly engages the valve seat 985. Following section 987 is a second conical section 983 of increasing cross sectional diameter, a cylindrical section 981 which sealingly engages forward bore portion 996, an intermediate cylindrical section 979 of smaller diameter than portion 981 and which defines an annular volume 941 between itself and the forward bore portion, a second cylindrical section 977 which also sealingly engages forward bore portion 996, and a second intermediate cylindrical section 975 of smaller diameter than portion 979 and which sealingly engages intermediate bore portion 998.

It is noted that the sealing engagement between the cylindrical sections of the valve stem and the bore portions is a relatively low pressure seal while the engagement between the conical section 987 and the valve seat 985 provides a high pressure seal.

A fluid conduit 961 is provided longitudinally of the valve stem from a side access opening 959 at conical section 983 to an end opening 957 at the rearward end of section 975.

A compression spring 973, disposed between plug 997 and valve stem portion 975 normally urges the valve stem forwardly and out of sealing engagement with valve seat 985.

Hydraulic fluid at a pressure prevalent in the tool cylinder communicates with bore 990 through a fluid conduit 971 formed in the release valve stem 992. When the hydraulic fluid pressure in the cylinder is below a predetermined threshold, the action of spring 973 takes precedence and the valve stem is unseated thus permitting hydraulic fluid communication between bore 990 and bore portion 998 rearwardly of the valve stem, via fluid conduit 961. In such a case the valve operates as a differential valve, since the hydraulic cylinder pressure is applied at opposite ends thereof in opposite directions.

Due to the difference in the cross sectional areas of the forward bore portion 996 and the intermediate bore portion 998, an increase in the hydraulic fluid pressure in the cylinder causes an increased force to be exerted on the valve stem in a rearward direction, forcing the valve stem against the urging of spring 973 into sealed seated engagement with the valve seat 985. Once the predetermined pressure threshold is reached, the valve stem seats and thus cuts off the fluid communication between bore 990 and fluid conduit 961, since opening 959 is located rearwardly of the seating surface of the valve stem. When seating occurs, the valve no longer acts as a differential valve, since the hydraulic fluid rearward of the valve seat loses pressure as it leaks through medium pressure sealing surfaces and via a conduit 949 to the hydraulic fluid reservoir.

Hydraulic fluid pumped through conduit 578 communicates with volume 941 via a conduit 943, when the valve stem is in a seated orientation as illustrated in FIG. 11. Since volume 941 communicates with the hydraulic fluid reservoir via conduit 949, the hydraulic fluid pumped through conduit 578 is drained to the reservoir when the two speed valve is seated, i.e. when a certain high pressure threshold is reached in the tool cylinder. When the high pressure threshold is not reached, however, the valve stem is positioned forwardly of its seated position and in such a position, second cylindrical section 977 provides a medium pressure seal between conduits 943 and 949 and does not permit drainage of the hydraulic fluid from conduit 578 to the hydraulic fluid reservoir. In such a case, the fluid pumped in conduit 578 contributes to the pressurization of the tool cylinder.

It will be appreciated by persons skilled in the art that the invention is not limited to what has been specifically shown and described hereinabove. For example, the two speed valves described hereinabove may equally well be applied to hydraulic tools other than single hand held and operated tools. Therefore the scope of the invention is defined only by the claims which follow.

I claim:

1. A single hand held and operated tool comprising:

a housing;

a hydraulic fluid reservoir located in said housing;

a hydraulic pressure cylinder located in said housing;

a hydraulic piston moving with respect to said pressure cylinder in response to hydraulic pressure produced therein;

a hydraulic pump operable by a single hand while grasping said housing and coupled to said fluid reservoir and to said pressure cylinder for forcing hydraulic fluid received from said reservoir into said cylinder; and valve means governing fluid communication between said hydraulic pump and said pressure cylinder and operative in response to hydraulic pressure in said cylinder for lowering the quantity of hydraulic fluid supplied to said cylinder by each pump stroke when the pressure in said cylinder exceeds a predetermined pressure, thus providing two-speed tool operation.

2. A single hand held and operated tool according to claim 1 and also comprising a release valve disposed within said housing and associated with said pressure cylinder for release of the hydraulic pressure therein in response to manual actuation thereof by a single hand unassisted.

3. A single hand held and operated tool according to claim 2 and also comprising means coupling said release valve and said valve means for automatically operating said release valve to release the hydraulic pressure in said pressure cylinder when the pressure therein exceeds a second predetermined pressure.

4. A single hand held and operated tool according to claim 1 and wherein said valve means comprises a differential valve.

5. A single hand held and operated tool according to claim 1 and wherein said valve means comprises at least one spring diaphragm.

6. A single hand held and operated tool according to claim 1 and wherein said valve means comprises:

a stationary valve member defining first and second recesses interconnected by a bore and defining a valve seat;

a first diaphragm spring sealingly disposed in said first recess to define mutually sealed first and second volumes;

a second diaphragm spring sealingly disposed in said second recess to define mutually sealed third and fourth volumes;

a hydraulic fluid communication path providing fluid communication between said pressure cylinder and said first and fourth volumes and thus bringing the hydraulic pressure in said pressure cylinder to bear on said first and second diaphragm springs in opposite directions;

the effective cross section of said first diaphragm spring being greater than the effective cross section of said second diaphragm spring;

a valve stem joined to said first and second diaphragm springs and defining a seating portion which selectably seats against said valve seat to sealingly interrupt the flow of fluid through said bore;

a hydraulic fluid drain path connecting said hydraulic pump to said hydraulic fluid reservoir via said bore and said valve seat so as to be interrupted when said valve stem is seated against said valve seat;

said valve means being operative such that under increasing pressure in said pressure cylinder, due to the difference in effective cross section of said first and second diaphragm springs an increasing net force is produced on said first and second diaphragm springs and on said valve stem urging said valve stem towards seating engagement with said valve seat and producing seating of said valve stem and interruption of said drain path upon exceedance of a predetermined pressure threshold in said pressure cylinder.

7. A single hand held and operated tool according to claim 1 and wherein said valve means comprises:

a stationary valve member defining a valve seat along the mouth of a bore extending longitudinally therein;

a valve stem disposed for travel within said bore and having a seating portion arranged for selectable sealing engagement with said valve seat;

said bore having a first section of larger cross sectional diameter and a second section of smaller cross sectional diameter and said valve stem having a first portion sealingly engaging said first section and a second portion sealingly engaging said second section;

said valve stem having an internal conduit permitting the flow of hydraulic fluid from a location facing said first portion to a location facing said second portion only when said valve stem is unseated;

spring means normally urging the valve stem into an unseated orientation;

a hydraulic fluid drain path connecting said hydraulic pump to said hydraulic fluid reservoir via said bore and said valve stem so as to be interrupted when said valve stem is in an unseated orientation;

said valve means being operative such that under increasing pressure in said pressure cylinder, due to the difference in effective cross sectional area of said first and second stem portions, an increasing net force is produced on said valve stem against the urging of said spring means urging said valve stem into seating engagement, thereby cutting off the hydraulic fluid flow via said internal conduit and permitting hydraulic fluid flow along said drain path upon exceedance of a predetermined pressure threshold in said pressure cylinder.

8. A hydraulic tool comprising:

a hydraulic fluid reservoir;

a hydraulic pressure cylinder;

a hydraulic piston moving with respect to said pressure cylinder in response to hydraulic pressure produced therein;

a hydraulic pump coupled to said fluid reservoir and to said pressure cylinder for forcing hydraulic fluid received from said reservoir into said cylinder;

valve means governing fluid communication between said hydraulic pump and said pressure cylinder and operative in response to hydraulic pressure in said cylinder for lowering the quantity of hydraulic fluid supplied to said cylinder by each pump stroke when the pressure in said cylinder exceeds a predetermined pressure, thus providing two-speed tool operation, said valve means comprising, a stationary valve member defining first and second recesses interconnected by a bore and defining a valve seat;

a first diaphragm spring sealingly disposed in said first recess to define mutually sealed first and second volumes;

a second diaphragm spring sealingly disposed in said second recess to define mutually sealed third and fourth volumes;

a hydraulic fluid communication path providing fluid communication between said pressure cylinder and said first and fourth volumes and thus bringing the hydraulic pressure in said pressure cylinder to bear on said first and second diaphragm springs in opposite directions;

the effective cross section of said first diaphragm spring being greater than the effective cross section of said second diaphragm spring;

a valve stem joined to said first and second diaphragm springs and defining a seating portion which selectably seats against said valve seat to sealingly interrupt the flow of fluid through said bore;

a hydraulic fluid drain path connecting said hydraulic pump to said hydraulic fluid reservoir via said bore and said valve seat so as to be interrupted when said valve stem is seated against said valve seat;

said valve means being operative such that under increasing pressure in said pressure cylinder, due to the difference in effective cross section of said first and second diaphragm springs an increasing net force is produced on said first and second diaphragm springs and on said valve stem urging said valve stem towrds seating engagement with said valve seat and producing seating of said valve stem and interruption of said drain path upon exceedance of a predetermined pressure threshold in said pressure cylinder.

9. A hydraulic tool comprising:

a hydraulic fluid reservoir;

a hydraulic pressure cylinder;

a hydraulic piston moving with respect to said pressure cylinder in response to hydraulic pressure produced therein;

a hydraulic pump coupled to said fluid reservoir and to said pressure cylinder for forcing hydraulic fluid received from said reservoir into said cylinder;

valve means governing fluid communication between said hydraulic pump and said pressure cylinder and operative in response to hydraulic pressure in said cylinder for lowering the quantity of hydraulic fluid supplied to said cylinder by each pump stroke when the pressure in said cylinder exceeds a predetermined pressure, thus providing two-speed tool operation, said valve means comprising, a stationary valve member defining a valve seat along the mouth of a bore extending longitudinally therein;

a valve stem disposed for travel within said bore and having a seating portion arranged for selectable sealing engagement with said valve seat;

said bore having a first section of larger cross sectional diameter and a second section of smaller cross sectional diameter and said valve stem having a first portion sealingly engaging said first section and a second portion sealingly engaging said second section;

said valve stem having an internal conduit permitting the flow of hydraulic fluid from a location facing said first portion to a location facing said second portion only when said valve stem is unseated;

spring means normally urging the valve stem into an unseated orientation;

a hydraulic fluid drain path connecting said hydraulic pump to said hydraulic fluid reservoir via said bore and said valve stem so as to be interrupted when said valve stem is in an unseated orientation;

said valve means being operative such that under increasing pressure in said pressure cylinder, due to the difference in effective cross sectional area of said first and second stem portions, an increasing net force is produced on said valve stem against the urging of said spring means urging said valve stem into seating engagement, thereby cutting off the hydraulic fluid flow via said internal conduit and permitting hydraulic fluid flow along said drain path upon exceedance of a predetermined pressure threshold in said pressure cylinder.

* * * * *